US010140962B2

(12) United States Patent
Nagayama et al.

(10) Patent No.: US 10,140,962 B2
(45) Date of Patent: Nov. 27, 2018

(54) DISPLAY UNIT, DISPLAY PANEL AND DRIVING METHOD THEREOF, AND DISPLAY DEVICE

(71) Applicant: BOE TECHNOLOGY GROUP CO., LTD., Beijing (CN)

(72) Inventors: Kazuyoshi Nagayama, Beijing (CN); Song Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/122,786

(22) PCT Filed: Jan. 7, 2016

(86) PCT No.: PCT/CN2016/070355

§ 371 (c)(1),
(2) Date: Aug. 31, 2016

(87) PCT Pub. No.: WO2017/028483

PCT Pub. Date: Feb. 23, 2017

(65) Prior Publication Data

US 2017/0186408 A1 Jun. 29, 2017

(30) Foreign Application Priority Data

Aug. 14, 2015 (CN) ..... 2015 1 0501988

(51) Int. Cl.
*G09G 5/391* (2006.01)
*G09G 3/20* (2006.01)
*G09G 5/02* (2006.01)

(52) U.S. Cl.
CPC ..... *G09G 5/391* (2013.01); *G09G 3/2003* (2013.01); *G09G 5/028* (2013.01); *G09G 2300/0452* (2013.01); *G09G 2340/0407* (2013.01)

(58) Field of Classification Search
CPC ..... G09G 3/2003; G09G 3/3607; G09G 2300/0452; G09G 3/2074; G09G 3/3611;
(Continued)

(56) References Cited

U.S. PATENT DOCUMENTS

2005/0264587 A1* 12/2005 Kurumisawa ..... G09G 3/2003 345/690
2006/0132660 A1* 6/2006 Kurumisawa ..... G09G 3/2003 348/631
(Continued)

FOREIGN PATENT DOCUMENTS

CN 1494036 A 5/2004
CN 101893792 A 11/2010
(Continued)

OTHER PUBLICATIONS

International Search Report dated May 10, 2016 corresponding to International application No. PCT/CN2016/070355.

*Primary Examiner* — Hong Zhou
(74) *Attorney, Agent, or Firm* — Nath, Goldberg & Meyer; Joshua B. Goldberg; Daniel Bissing

(57) ABSTRACT

The present invention discloses a display unit, a display panel and a driving method thereof, wherein the display unit comprises a full color display subunit capable of displaying full color, and at least one black and white display subunit capable of displaying black and white, when the display unit operates in a first display mode, the full color display subunit and all the black and white display subunit(s) in the display unit display one pixel together; and when the display unit operates in a second display mode, the full color display subunit in the display unit displays one color pixel, and each black and white display subunit in the display unit displays one black/white pixel independently. According to the present invention, pixel display information at the boundaries can be increased, that is, display resolution of the display panel is improved, thereby improving display quality of the display panel.

18 Claims, 3 Drawing Sheets

(58) Field of Classification Search
CPC ..... G09G 2340/06; G09G 5/02; G09G 2340/0457; G09G 2300/0439; G09G 2310/04; G09G 2340/0407; G09G 2340/0414; G09G 2340/0421; G09G 3/3225; G09G 3/364; G09G 5/028; G09G 5/391
See application file for complete search history.

(56) References Cited

U.S. PATENT DOCUMENTS

| | | | | |
|---|---|---|---|---|
| 2008/0266318 | A1* | 10/2008 | Peeters | G09G 3/3607 345/603 |
| 2008/0303767 | A1* | 12/2008 | Ludden | G09G 3/3688 345/89 |
| 2012/0026210 | A1* | 2/2012 | Yano | G09G 3/3607 345/690 |
| 2012/0327137 | A1* | 12/2012 | Saitoh | G09G 3/3648 345/690 |
| 2013/0141481 | A1* | 6/2013 | Peng | G02F 1/134309 345/694 |
| 2015/0077447 | A1* | 3/2015 | Zhang | G02F 1/167 345/694 |
| 2016/0027405 | A1* | 1/2016 | Nakanishi | G09G 3/2003 345/590 |

FOREIGN PATENT DOCUMENTS

| | | |
|---|---|---|
| CN | 102770901 A | 11/2012 |
| CN | 105096801 | 11/2015 |
| JP | H1010517 | 1/1998 |

* cited by examiner

DISPLAY UNIT, DISPLAY PANEL AND DRIVING METHOD THEREOF, AND DISPLAY DEVICE

This is a National Phase Application filed under 35 U.S.C. 371 as a national stage of PCT/CN2016/070355, filed Jan. 7, 2016, an application claiming the benefit of Chinese Application No. 201510501988.4, filed Aug. 14, 2015, the content of each of which is hereby incorporated by reference in its entirety.

FIELD OF THE INVENTION

The present invention relates to the field of display technology, and particularly relates to a display unit, a display panel and a driving method thereof, and a display device.

BACKGROUND OF THE INVENTION

With the development of science and technology and the improvement of living standards, people have higher and higher requirements for quality of image display, so that display devices with high display resolution have become the mainstream of the market.

At present, manufacturers usually improve display resolution of a display panel by means of increasing physical resolution of the display panel, that is, by increasing the number of pixels on the display panel so as to improve display effects of the display panel. In particular, sizes of the pixels on the display panel are reduced, so as to provide more pixels on the display panel.

However, limited by manufacturing process, the sizes of the pixels on the display panel, which have been reduced to a certain extent, cannot be reduced anymore, so that the physical resolution of the display panel cannot be further increased and the improvement in the display resolution of the display panel hits a bottleneck. Therefore, how to further improve the display resolution of the display panel becomes a technical problem to be solved urgently in the art.

SUMMARY OF THE INVENTION

The present invention provides a display unit, a display panel and a driving method thereof, and a display device, which can effectively improve display resolution of a display panel without changing physical resolution of the display panel.

For achieving the above object, the present invention provides a display unit, comprising a full color display subunit capable of displaying full color, and at least one black and white display subunit capable of displaying black and white;

in a first display mode, the full color display subunit and all the black and white display subunit(s) in the display unit display one pixel together; and in a second display mode, the full color display subunit in the display unit displays one color pixel, and each black and white display subunit in the display unit displays one black/white pixel independently.

Optionally, the display unit comprises four sub-pixels arranged in one row and four columns;

wherein three adjacent sub-pixels constitute the full color display subunit, and remaining one sub-pixel constitutes the black and white display subunit.

Optionally, the display unit comprises four sub-pixels arranged in two rows and two columns;

wherein three adjacent sub-pixels constitute the full color display subunit, and remaining one sub-pixel constitutes the black and white display subunit.

Optionally, the display unit comprises eight sub-pixels arranged in two rows and four columns;

wherein three adjacent sub-pixels in a same row constitute the full color display subunit, and each of remaining five sub-pixels constitutes a black and white display subunit independently.

Optionally, the three sub-pixels which constitute the full color display subunit are respectively a red sub-pixel, a green sub-pixel and a blue sub-pixel; or the three sub-pixels which constitute the full color display subunit are respectively a yellow sub-pixel, a magenta sub-pixel and a cyan sub-pixel.

Optionally, the sub-pixel which constitutes the black and white display subunit is a white sub-pixel.

Optionally, the display unit comprises eight sub-pixels arranged in two rows and four columns;

wherein three adjacent sub-pixels in a same row constitute the full color display subunit, three adjacent sub-pixels, which are located in a row different from the row where the three sub-pixels in the full color display subunit are located, constitute a black and white display subunit, and each of remaining two sub-pixels constitutes a black and white display subunit independently.

Optionally, the three sub-pixels in the full color display subunit are respectively a red sub-pixel, a green sub-pixel and a blue sub-pixel; or, the three sub-pixels in the full color display subunit are respectively a yellow sub-pixel, a magenta sub-pixel and a cyan sub-pixel.

Optionally, in a case where the three sub-pixels in the full color display subunit are respectively a red sub-pixel, a green sub-pixel and a blue sub-pixel, the three sub-pixels, which constitute a black and white display subunit, are respectively a yellow sub-pixel, a magenta sub-pixel and a cyan sub-pixel; and in a case where the three sub-pixels in the full color display subunit are respectively a yellow sub-pixel, a magenta sub-pixel and a cyan sub-pixel, the three sub-pixels, which constitute a black and white display subunit, are respectively a red sub-pixel, a green sub-pixel and a blue sub-pixel.

Optionally, each of the two sub-pixels, which constitutes a black and white display subunit independently, is a white sub-pixel.

For achieving the above object, the present invention further provides a display panel, comprising a plurality of the aforesaid display units.

For achieving the above object, the present invention further provides a driving method of the aforesaid display panel, and the driving method of the display panel comprises:

driving the display units located at boundaries between color graphics and black and white graphics to display in a second display mode; and simultaneously, driving the display units which are not located at the boundaries between color graphics and black and white graphics to display in a first display mode.

For achieving the above object, the present invention further provides a display device, comprising the aforesaid display panel.

The present invention has the following beneficial effects:

the present invention provides a display unit, a display panel and a driving method thereof, and a display device, wherein the display unit comprises a full color display subunit capable of displaying full color, and at least one black and white display subunit capable of displaying black and white, when the display unit operates in a first display mode, the full color display subunit and all the black and white display subunit(s) in the display unit display one pixel together; and when the display unit operates in a second display mode, the full color display subunit in the display unit displays one color pixel, and each black and white display subunit in the display unit displays one black/white pixel independently. When there are color graphics and black and white graphics in an image to be displayed on a display panel, the display units located at boundaries between color graphics and black and white graphics can be driven to display in a second display mode, so as to increase the amount of pixel display information at the boundaries, that is, to improve display resolution of the display panel, thereby improving display quality of the display panel.

DETAILED DESCRIPTION OF THE EMBODIMENTS

In order to make those skilled in the art better understand the technical solutions of the present invention, a display unit, a display panel and a driving method thereof, and a display device provided in the present invention will be further described in detail below with reference to the accompanying drawings.

Embodiment 1

Figure 1:
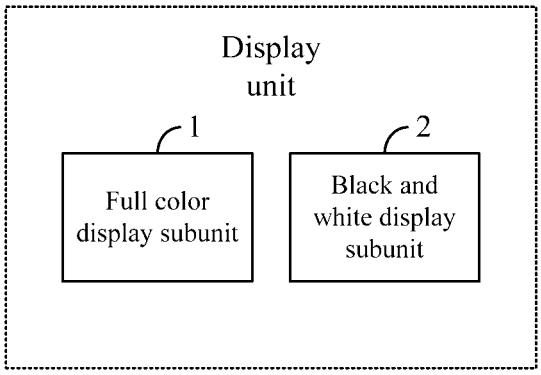
FIG. 1 is a block diagram illustrating configuration of a display unit provided in Embodiment 1 of the present invention.

FIG. 1 is a block diagram illustrating configuration of a display unit provided in Embodiment 1 of the present invention. As shown in FIG. 1, Embodiment 1 of the present invention provides a display unit, comprising a full color display subunit 1 capable of displaying full color, and at least one black and white display subunit 2 capable of displaying black and white (Only one black and white display subunit 2 is exemplarily shown in FIG. 1); the display unit provided in the present invention has two display modes, that is, a first display mode and a second display mode, wherein, in the first display mode, the full color display subunit 1 and all the black and white display subunit(s) 2 in the display unit display one pixel together; and in the second display mode, the full color display subunit 1 in the display unit displays one color pixel, and each black and white display subunit 2 in the display unit displays one black/white pixel independently.

It should be noted that, in the first display mode, the working mode of the display unit is the same as that in the prior art, that is, one display unit can display only one pixel, so that the display unit can provide only one piece of pixel display information for a user; while in the second display mode, the display unit can display one full color pixel and at least one black/white pixel, that is, one display unit can display at least two pixels, so that the display unit can provide at least two pieces of pixel display information for the user. Therefore, for the user, when there are some display units which operate in the second mode in a display panel, the amount of the pixel display information provided by the display units which operate in the second mode increases, so that fineness of the images on the display panel, which are corresponding to the positions of the display units which operate in the second mode, will be improved, that is, the display resolution of the display panel will be effectively improved.

In order to make those skilled in the art better understand the technical solutions of the present invention, corresponding description will be given below with reference to specific implementations.

Figure 2:
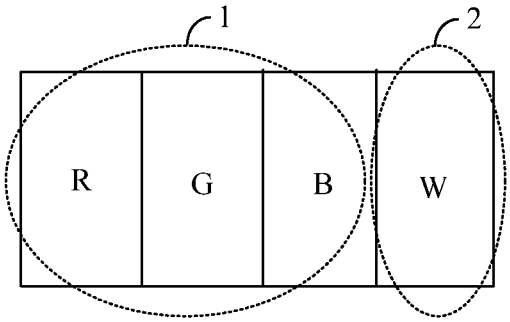
FIG. 2 is a schematic diagram illustrating specific configuration of a first kind of the display unit provided in Embodiment 1 of the present invention.

FIG. 2 is a schematic diagram illustrating specific configuration of a first kind of the display unit provided in Embodiment 1 of the present invention. As shown in FIG. 2, the display unit comprises four sub-pixels arranged in one row and four columns, wherein three adjacent sub-pixels constitute the full color display subunit 1, and remaining one sub-pixel constitutes the black and white display subunit 2.

It should be noted that the three sub-pixels which constitute the full color display subunit 1 in FIG. 2 are respectively a red sub-pixel R, a green sub-pixel G and a blue sub-pixel B, which will not make limitations on the technical solution of the present application. In the present application, any combination of three sub-pixels in different colors used for full color display should fall into the protection scope of the present application. For example, the three sub-pixels which constitute the full color display subunit 1 are respectively a yellow sub-pixel, a magenta sub-pixel and a cyan sub-pixel. In FIG. 2, the sub-pixel which constitutes the black and white display subunit 2 is a white sub-pixel W.

When the display unit shown in FIG. 2 operates in the first display mode, the red sub-pixel R, the green sub-pixel G, the blue sub-pixel B and the white sub-pixel W display one color pixel together, in which case the white sub-pixel W is configured to cooperate with the red sub-pixel R, the green sub-pixel G and the blue sub-pixel B to perform pixel display (the function of the white sub-pixel W is to adjust brightness of the pixel displayed by the display unit); when the display unit shown in FIG. 2 operates in the second display mode, the red sub-pixel R, the green sub-pixel G and the blue sub-pixel B display one color pixel together, and the white sub-pixel W displays one white pixel or one black pixel independently (the function of the white sub-pixel W is to display one white/black pixel independently). It can be seen from the above that the display unit shown in FIG. 2 can provide two pieces of pixel display information in the second display mode.

When there are color graphics and black and white graphics in an image to be displayed on a display panel, the display units located at boundaries between color graphics and black and white graphics can be made to display in the second display mode, so as to increase the amount of pixel display information at the boundaries, that is, to improve display resolution of the display panel, in such a way, the user can perceive that graphics outlines at the boundaries become more fine and smooth.

Figure 3:
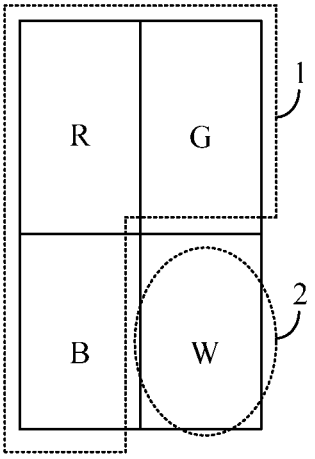
FIG. 3 is a schematic diagram illustrating specific configuration of a second kind of the display unit provided in Embodiment 1 of the present invention.

FIG. 3 is a schematic diagram illustrating specific configuration of a second kind of the display unit provided in Embodiment 1 of the present invention. As shown in FIG. 3, the display unit comprises four sub-pixels arranged in two rows and two columns, wherein three adjacent sub-pixels constitute the full color display subunit 1, and remaining one sub-pixel constitutes the black and white display subunit 2. Description of the two display modes of the display unit shown in FIG. 3 may refer to the aforesaid description of the display unit shown in FIG. 2, which will not be repeated here.

Figure 4:
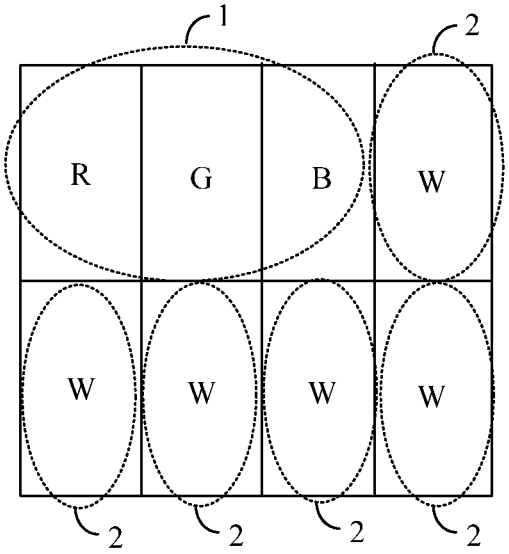
FIG. 4 is a schematic diagram illustrating specific configuration of a third kind of the display unit provided in Embodiment 1 of the present invention.

FIG. 4 is a schematic diagram illustrating specific configuration of a third kind of the display unit provided in Embodiment 1 of the present invention. As shown in FIG. 4, the display unit is distinguished from the display units shown in FIGS. 2 and 3 by comprising eight sub-pixels arranged in two rows and four columns, wherein, three adjacent sub-pixels in a same row constitute the full color display subunit 1, and each of remaining five sub-pixels constitutes a black and white display subunit 2 independently.

It should be noted that it merely serves as an example that the three sub-pixels, which are located in the first row and in the first, second and third columns, constitute the full color display subunit 1 in FIG. 4. Those skilled in the art should understand that the three sub-pixels which constitute the full color display subunit 1 can be other three sub-pixels whose positions are "adjacent to each other in a same row" among the eight sub-pixels, and examples of said other three sub-pixels will not be listed here one by one.

It should be noted that the three sub-pixels which constitute the full color display subunit 1 in FIG. 4 are respectively a red sub-pixel R, a green sub-pixel G and a blue sub-pixel B, which will not make limitations on the technical solution of the present invention. In the present application, any combination of three sub-pixels in different colors used for full color display should fall into the protection scope of the present application. For example, the three sub-pixels which constitute the full color display subunit 1 are respectively a yellow sub-pixel, a magenta sub-pixel and a cyan sub-pixel. In FIG. 4, each of the remaining five sub-pixels is a white sub-pixel W; and in the second display mode, each white sub-pixel W constitutes a black and white display subunit 2 independently, and each of the five black and white display subunits 2 can display a black/white pixel independently. It can be seen from the above that the display unit can provide six pieces of pixel display information in the second display mode.

When the display unit shown in FIG. 4 operates in the second display mode to display the boundaries between color graphics and black and white graphics, it can further improve the fineness of the boundaries as compared with the display units shown in FIGS. 2 and 3.

In addition, when the display unit shown in FIG. 4 operates in the first display mode to display, that is, the white sub-pixel W is configured to cooperate with the red sub-pixel R, the green sub-pixel G and the blue sub-pixel B to perform pixel display (the function of the white sub-pixel W is to adjust brightness of the pixel displayed by the display unit), the maximum brightness of the display unit can be effectively increased because the display unit has a great number of white sub-pixels W, so that contrast of the display panel can be effectively improved.

Figure 5:
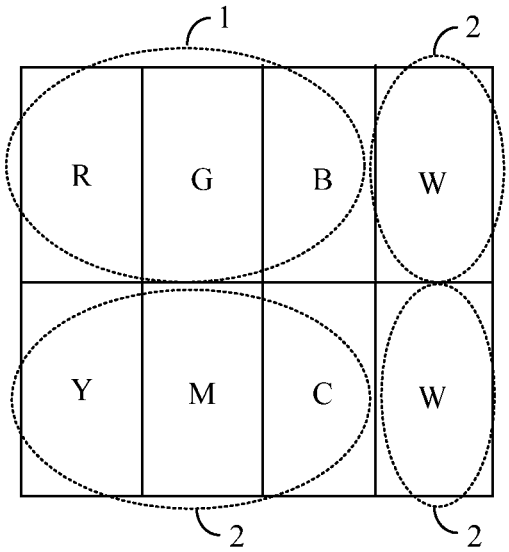
FIG. 5 is a schematic diagram illustrating specific configuration of a fourth kind of the display unit provided in Embodiment 1 of the present invention.

FIG. 5 is a schematic diagram illustrating specific configuration of a fourth kind of the display unit provided in Embodiment 1 of the present invention. As shown in FIG. 5, the display unit comprises eight sub-pixels arranged in two rows and four columns, wherein, three adjacent sub-pixels in a same row constitute the full color display subunit 1, three adjacent sub-pixels, which are located in a row different from the row where the three sub-pixels in the full color display subunit 1 are located, constitute a black and white display subunit 2, and each of remaining two sub-pixels constitutes a black and white display subunit 2 independently.

It should be noted that it merely serves as an example that the three sub-pixels, which are located in the first row and in the first, second and third columns, constitute the full color display subunit 1, and the three sub-pixels, which are located in the second row and in the first, second and third columns, constitute the black and white display subunit 2 in FIG. 5. Those skilled in the art should understand that the three sub-pixels which constitute the full color display subunit 1 can be other three sub-pixels whose positions are "adjacent to each other in a same row" among the eight sub-pixels, the three sub-pixels which constitute the black and white display subunit 2 can be other three sub-pixels whose positions are "adjacent to each other and in a row different from the row where the three sub-pixels in the full color display subunit 1 are located", and examples of said other three sub-pixels will not be listed here one by one.

Optionally, the three sub-pixels in the full color display subunit 1 are respectively a red sub-pixel R, a green sub-pixel G and a blue sub-pixel B, the three sub-pixels, which constitute the black and white display subunit 2, are respectively a yellow sub-pixel Y, a magenta sub-pixel M and a cyan sub-pixel C, and a yellow sub-pixel Y, a magenta sub-pixel M and a cyan sub-pixel C constitute a black and white display subunit 2; or the three sub-pixels in the full color display subunit 1 are respectively a yellow sub-pixel Y, a magenta sub-pixel M and a cyan sub-pixel C, the three sub-pixels, which constitute the black and white display subunit 2, are respectively a red sub-pixel R, a green sub-pixel G and a blue sub-pixel B, and a red sub-pixel R, a green sub-pixel G and a blue sub-pixel B constitute a black and white display subunit 2.

In this embodiment, description is made by using an example that the three sub-pixels, which are located in the first row and in the first, second and third columns, constitute the full color display subunit 1, and the three sub-pixels which constitute the full color display subunit 1 are respectively a red sub-pixel R, a green sub-pixel. G and a blue sub-pixel B. In such case, the three sub-pixels, which are located in the second row and in the first, second and third columns, constitute the black and white display subunit 2, the three sub-pixels, which constitute the black and white display subunit 2, are respectively a yellow sub-pixel Y, a magenta sub-pixel M and a cyan sub-pixel C, and the two sub-pixels in the fourth column are white sub-pixels W.

When the display unit shown in FIG. 5 operates in the first display mode, it can display more colors than the display units shown in FIGS. 2, 3 and 4, because it comprises six color sub-pixels (a red sub-pixel R, a green sub-pixel G, a blue sub-pixel B, a yellow sub-pixel Y, a magenta sub-pixel M and a cyan sub-pixel C).

When the display unit shown in FIG. 5 operates in the second display mode, a red sub-pixel R, a green sub-pixel G and a blue sub-pixel B display one color pixel together, a yellow sub-pixel Y, a magenta sub-pixel M and a cyan sub-pixel C display one black/white pixel together, and each of the remaining two white sub-pixels W displays one black/white pixel independently. It can be seen from the above that the display unit can provide four pieces of pixel display information in the second display mode.

It should be noted that the aforesaid four configurations of the display unit shown in FIGS. 2-5 will not make limitations on the technical solutions of the present invention, and those skilled in the art should understand that the display unit of the present invention can adopt other configurations which will not be listed here one by one.

Embodiment 1 of the present invention provides a display unit, comprising a full color display subunit capable of displaying full color, and at least one black and white display subunit capable of displaying black and white, when the display unit operates in a first display mode, the full color display subunit and all the black and white display subunit(s) in the display unit display one pixel together; and when the display unit operates in a second display mode, the full color display subunit in the display unit displays one color pixel, and each black and white display subunit in the display unit displays one black/white pixel independently. When there are color graphics and black and white graphics in an image to be displayed on a display panel, the display units located at boundaries between color graphics and black and white graphics can be made to display in the second display mode, so as to increase the amount of pixel display information at the boundaries, that is, to improve display resolution of the display panel, in such a way, the user can perceive that graphics outlines at the boundaries become more fine and smooth.

Embodiment 2

Embodiment 2 of the present invention provides a display panel, comprising a plurality of the display units provided in the above Embodiment 1. Description of the display unit may refer to the aforesaid description in Embodiment 1, which will not be repeated here.

Embodiment 2 of the present invention further provides a driving method of the aforesaid display panel, wherein each display unit in the display panel has a first display mode and a second display mode, and the driving method of the display panel comprises:

step 101: driving the display units located at boundaries between color graphics and black and white graphics to display in the second display mode; and step 102: driving the display units which are not located at the boundaries of color graphics and black and white graphics to display in the first display mode.

It should be noted that the above steps 101 and 102 are performed simultaneously.

In order to make those skilled in the art better understand the technical solution of the present invention, the driving method will be described in detail below by taking a process of displaying a frame of image by the display panel provided in this embodiment as an example. Wherein, those skilled in the art should understand that a frame of image (except a solid color image) to be displayed by the display panel can be considered to be formed by stitching a plurality of color graphics and black and white graphics, and the fineness of the outlines of those color graphics and black and white graphics (boundaries between those color graphics and black and white graphics) has a direct influence on the fineness of the whole image.

Firstly, the display panel may receive video stream information corresponding to the frame of image; then, a chip in the display panel performs digital image processing on the video stream information so as to calculate positions of all the boundaries between color graphics and black and white graphics of the frame of image to be displayed by the display panel; then, according to the video stream information, the chip calculates a data signal corresponding to each sub-pixel in the display unit which is located at the boundary between color graphics and black and white graphics, and a data signal corresponding to each sub-pixel in the display unit which is not located at the boundary between color graphics and black and white graphics by adopting corresponding algorithms; and finally, according to the obtained data signals, a driving module in the display panel drives the display units located at the boundaries between color graphics and black and white graphics to display in the second display mode, and stimutaneously, drives the display units which are not located at the boundaries between color graphics and black and white graphics to display in the first display mode.

It can be seen from the above that the technical solution of this embodiment can effectively increase the amount of pixel display information at the boundaries between color graphics and black and white graphics, that is, the display resolution of the display panel is improved, so that the user can perceive that graphics outlines at the boundaries become more fine and smooth, and the fineness of the displayed image of the display panel is improved.

Embodiment 3

Embodiment 3 of the present invention provides a display device, comprising the display panel provided in the above Embodiment 2. Description of the display panel may refer to the aforesaid description in Embodiment 2, which will not be repeated here.

It can be understood that the foregoing implementations are merely exemplary implementations adopted for describing the principle of the present invention, but the present invention is not limited thereto. Those of ordinary skill in the art can make various variations and improvements without departing from the spirit and essence of the present invention, and these variations and improvements shall be considered to fall into the protection scope of the present invention.

The invention claimed is:

1. A display unit, comprising: a full color display subunit capable of displaying full color, and at least one black and white display subunit capable of displaying black and white;

wherein the full color display subunit and the at least one black and white display subunit are configured such that;

in a case where a display panel to which the display unit belongs is to display a frame of an image, including both a color graph and a black and white graph, and the display unit is not located at a boundary between the color graph and the black and white graph, the full color display subunit and all the black and white display subunit(s) in the display unit display one pixel together; and in a case where a display panel to which the display unit belongs is to display a frame of an image, including both a color graph and a black and white graph, and the display unit is located at the boundary between the color graph and the black and white graph, the full color display subunit in the display unit displays one full-color pixel, and concurrently each black and white display subunit in the display unit forms one black and white pixel and performs display independently from the full-color pixel.

2. The display unit of claim 1, comprising four sub-pixels arranged in one row and four columns;

wherein, three adjacent sub-pixels constitute the full color display subunit, and remaining one sub-pixel constitutes the black and white display subunit.

3. The display unit of claim 2, wherein, the three sub-pixels which constitute the full color display subunit are respectively a red sub-pixel, a green sub-pixel and a blue sub-pixel; or, the three sub-pixels which constitute the full color display subunit are respectively a yellow sub-pixel, a magenta sub-pixel and a cyan sub-pixel.

4. The display unit of claim 2, wherein, the sub-pixel which constitutes the black and white display subunit is a white sub-pixel.

5. The display unit of claim 1, comprising four sub-pixels arranged in two rows and two columns;

wherein, three adjacent sub-pixels constitute the full color display subunit, and remaining one sub-pixel constitutes the black and white display subunit.

6. The display unit of claim 5, wherein, the three sub-pixels which constitute the full color display subunit are respectively a red sub-pixel, a green sub-pixel and a blue sub-pixel; or, the three sub-pixels which constitute the full color display subunit are respectively a yellow sub-pixel, a magenta sub-pixel and a cyan sub-pixel.

7. The display unit of claim 5, wherein, the sub-pixel which constitutes the black and white display subunit is a white sub-pixel.

8. The display unit of claim 1, comprising eight sub-pixels arranged in two rows and four columns;

wherein, three adjacent sub-pixels in a same row constitute the full color display subunit, and each of remaining five sub-pixels constitutes a black and white display subunit independently.

9. The display unit of claim 8, wherein, the three sub-pixels which constitute the full color display subunit are respectively a red sub-pixel, a green sub-pixel and a blue sub-pixel; or, the three sub-pixels which constitute the full color display subunit are respectively a yellow sub-pixel, a magenta sub-pixel and a cyan sub-pixel.

10. The display unit of claim 8, wherein, the sub-pixel which constitutes the black and white display subunit is a white sub-pixel.

11. The display unit of claim 1, comprising eight sub-pixels arranged in two rows and four columns;

wherein, three adjacent sub-pixels in a same row constitute the full color display subunit, three adjacent sub-pixels, which are located in a row different from the row where the three sub-pixels in the full color display subunit are located, constitute a black and white display subunit, and each of remaining two sub-pixels constitutes a black and white display subunit independently.

12. The display unit of claim 11, wherein, the three sub-pixels in the full color display subunit are respectively a red sub-pixel, a green sub-pixel and a blue sub-pixel; or, the three sub-pixels in the full color display subunit are respectively a yellow sub-pixel, a magenta sub-pixel and a cyan sub-pixel.

13. The display unit of claim 12, wherein, in a case where the three sub-pixels in the full color display subunit are respectively a red sub-pixel, a green sub-pixel and a blue sub-pixel, the three sub-pixels, which constitute a black and white display subunit, are respectively a yellow sub-pixel, a magenta sub-pixel and a cyan sub-pixel; and in a case where the three sub-pixels in the full color display subunit are respectively a yellow sub-pixel, a magenta sub-pixel and a cyan sub-pixel, the three sub-pixels, which constitute a black and white display subunit, are respectively a red sub-pixel, a green sub-pixel and a blue sub-pixel.

14. The display unit of claim 13, wherein, each of the two sub-pixels, which constitutes a black and white display subunit independently, is a white sub-pixel.

15. The display unit of claim 12, wherein, each of the two sub-pixels, which constitutes a black and white display subunit independently, is a white sub-pixel.

16. The display unit of claim 11, wherein, each of the two sub-pixels, which constitutes a black and white display subunit independently, is a white sub-pixel.

17. A display panel, comprising a plurality of the display units of claim 1.

18. A driving method of the display panel of claim 17, comprising:

driving the display units located at boundaries between color graphics and black and white graphics to display in a second display mode; and simultaneously, driving the display units which are not located at the boundaries between color graphics and black and white graphics to display in a first display mode.

* * * * *